US008976628B2

(12) United States Patent
Leoni et al.

(10) Patent No.: US 8,976,628 B2
(45) Date of Patent: Mar. 10, 2015

(54) WRISTWATCH PROVIDED WITH AN ELECTRICAL CONNECTOR

(71) Applicant: ETA SA Manufacture Horlogere Suisse, Grenchen (CH)

(72) Inventors: Stephane Leoni, Courtelary (CH); Thierry Bonnet, Geneva (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/093,723

(22) Filed: Dec. 2, 2013

(65) Prior Publication Data

US 2014/0160896 A1 Jun. 12, 2014

(30) Foreign Application Priority Data

Dec. 6, 2012 (EP) ..... 12195918

(51) Int. Cl.
*G04B 47/00* (2006.01)
*G04G 17/06* (2006.01)
*G04G 21/00* (2010.01)

(52) U.S. Cl.
CPC ..... *G04G 17/06* (2013.01); *G04G 21/00* (2013.01)
USPC ..... 368/10

(58) Field of Classification Search
CPC ..... G04G 17/06; G04G 21/00; G04G 47/00; G04G 21/04; G04G 15/006
USPC ..... 368/10, 204, 281–282, 37; 439/37; 343/718
See application file for complete search history.

(56) References Cited

U.S. PATENT DOCUMENTS

| | | | | |
|---|---|---|---|---|
| 3,973,706 | A * | 8/1976 | Boyce et al. | 224/165 |
| 6,619,835 | B2 * | 9/2003 | Kita | 368/281 |
| 2004/0081025 | A1 | 4/2004 | Chen | |
| 2004/0084200 | A1 | 5/2004 | Noirjean | |
| 2006/0140055 | A1 | 6/2006 | Ehrsam et al. | |
| 2007/0064542 | A1 | 3/2007 | Fukushima | |
| 2007/0279852 | A1 | 12/2007 | Daniel et al. | |
| 2008/0248838 | A1 | 10/2008 | Chiang | |

FOREIGN PATENT DOCUMENTS

| | | |
|---|---|---|
| CN | 2921901 | 7/2007 |
| CN | 200993734 | 12/2007 |
| EP | 1 416 582 A1 | 5/2004 |

(Continued)

OTHER PUBLICATIONS

European Search Report issued May 10, 2013 in European Application 12195918, filed on Dec. 6, 2012 ( with English Translation).

*Primary Examiner* — Edwin A. Leon
(74) *Attorney, Agent, or Firm* — Oblon, McClelland, Maier & Neustadt, L.L.P.

(57) ABSTRACT

The wristwatch (1) is provided with an electrical connector (5), which is connected via a connection element (15) to at least one electronic circuit and/or to a rechargeable battery which are disposed inside the watch case. The electrical connector (5) is a female USB electrical connector, which is disposed on an inner surface of the bracelet (4), and where the bracelet is fixed to the middle part (3) of the watch case. The inner surface of the bracelet comes into contact with the user's wrist when the watch is worn. The connection element (15) passes through the middle part to connect a contact area of the electrical connector to the electronic circuit and/or the rechargeable battery inside the case.

9 Claims, 2 Drawing Sheets

(56) References Cited

FOREIGN PATENT DOCUMENTS

| | | | |
|---|---|---|---|
| EP | 1 491 973 | A1 | 12/2004 |
| EP | 1 978 648 | A1 | 10/2008 |
| FR | 2 641 092 | A1 | 6/1990 |
| WO | WO 2005/083546 | A1 | 9/2005 |

* cited by examiner

Fig. 1
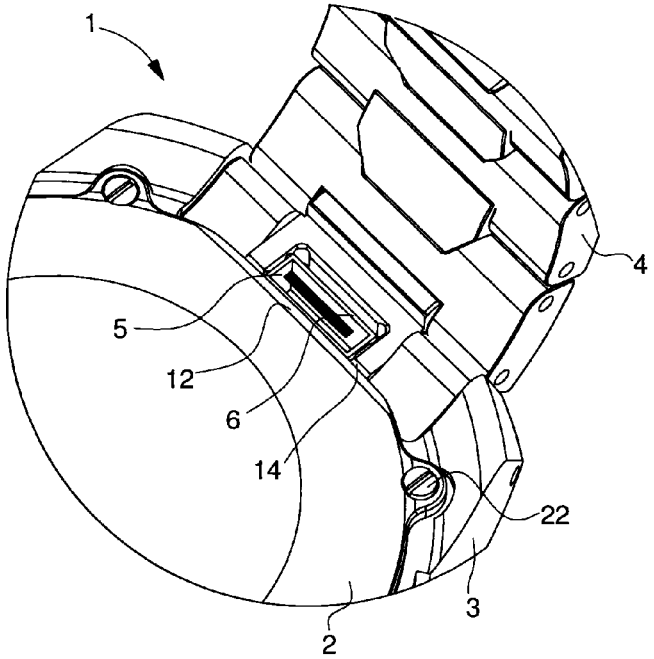
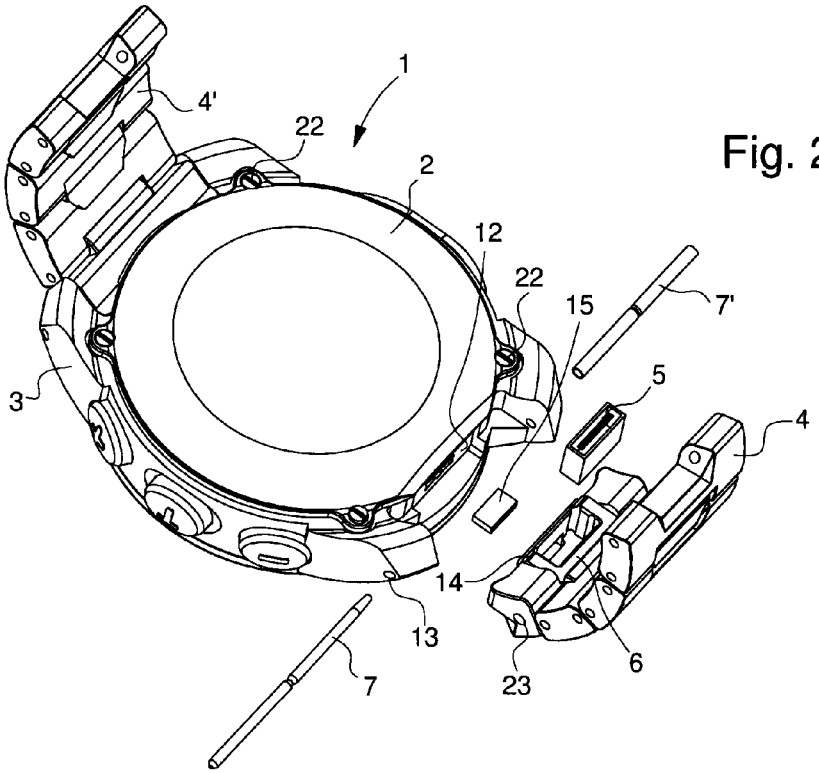
Fig. 2

Fig. 3
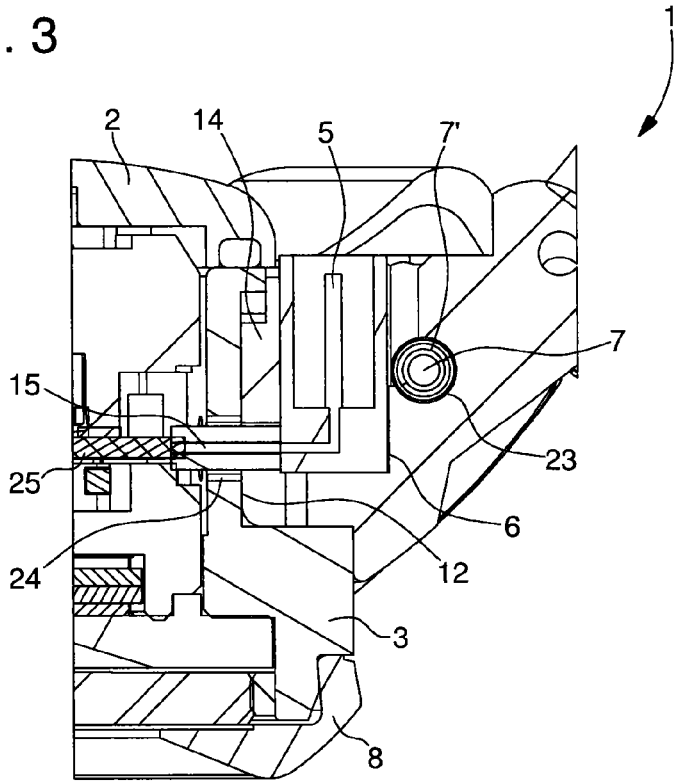
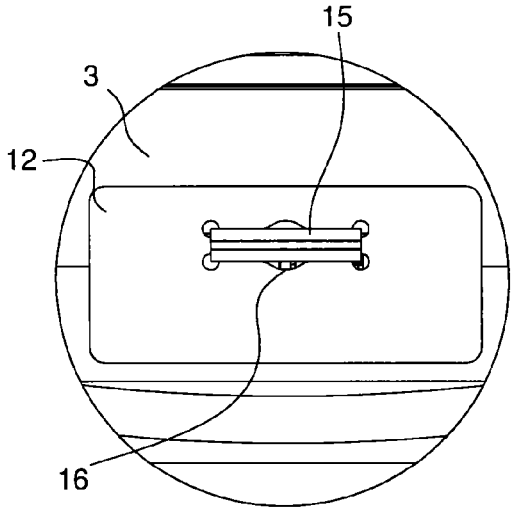
Fig. 4

WRISTWATCH PROVIDED WITH AN ELECTRICAL CONNECTOR

CROSS-REFERENCE TO RELATED APPLICATION

This application claims priority from European Patent Application No. 12195918.3 filed 6 Dec. 2012, the entire disclosure of which is incorporated herein by reference.

FIELD OF THE INVENTION

The present invention concerns a wristwatch provided with an electrical connector, for example a USB type connector. The electrical connector is connected via a connection element to at least one electronic circuit and/or to a rechargeable battery, which are arranged inside the watch case.

BACKGROUND OF THE INVENTION

An electromechanical watch may include an electronic unit for receiving radio frequency positioning signals or transmitting data signals, or also for controlling several watch functions. This type of watch may be provided with a colour display device, which requires the use of a rechargeable battery. A connection element may be arranged in the watch, in conjunction with said battery, so as to connect said connection element to a charging apparatus in order to charge the battery or transfer data. The connection element may take the form of a USB connector for connection to a computer or a wall-mounted charger. A male USB connector may be located at the fastening end of a watch bracelet strand, as disclosed in U.S. Pat. No. 7,006,408 B2. It is generally difficult to protect or conceal this type of USB connector, which is a drawback.

In this regard, CN Patent No 200993734 may be cited, which discloses an electronic watch, provided with a storage unit rotatably mounted between two horns for securing the bracelet to the watch case. This storage unit includes a male USB connector at the opposite end to the end secured to the case. The bracelet includes a housing for receiving the USB connector in the rest position. The USB connector may easily be moved in rotation to connect it to a charger device or to a device for processing or saving data contained in the storage unit. This type of storage unit with the USB connector is of large dimensions and cannot be totally concealed. Further, it is also difficult to protect the unit from environmental conditions, which are drawbacks.

CN Utility Model No 2921901U may also be cited, which discloses an electronic watch with at least one electrical connector or plug. This electrical plug, shown in the form of a cinch or RCA connector, is fixed through an aperture in the middle part of the watch case. The plug is also mounted in an end housing in the bracelet, which is open on the watch crystal side. The plug may also be connected to a male USB connector, which is fixed to the bracelet in proximity to the bracelet clasp. The plug is still visible when the watch is worn on the user's wrist and it is difficult to protect it from environmental conditions, which are drawbacks.

SUMMARY OF THE INVENTION

It is therefore an object of the invention to overcome the aforementioned drawbacks by proposing a wristwatch provided with an electrical connector on the bracelet for accessing an electronic circuit inside the watch and/or a rechargeable battery, which has a simple design, is not visible when worn on the wrist and is protected from environmental conditions.

The present invention therefore concerns a wristwatch, which is provided with an electrical connector, the electrical connector being connected via a connection element to at least one electronic circuit and/or to a rechargeable battery which are disposed inside the watch case, wherein the electrical connector is disposed on an inner surface of the bracelet, which comes into contact with the user's wrist when the watch is worn, and arranged in an end portion of the bracelet where the bracelet is secured to the middle part of the watch case.

Specific embodiments of the wristwatch are defined in the dependent claims 2 to 12.

One advantage of the wristwatch according to the invention lies in the fact that the electrical connector, particularly a USB connector, is arranged on the inner surface of the bracelet in proximity to the middle part of the watch case. Thus, the electrical connector is protected from environmental conditions when the watch is worn on the user's wrist. The electrical connector is connected via a connection element, which is arranged through the middle part of the case, to an electronic circuit on a printed circuit board and/or to a rechargeable battery.

Advantageously, the female electrical connector, arranged in the last link of the bracelet, allows the connection of a USB or HDMI plug in a vertical direction of insertion relative to the inner curve of the bracelet or strap. For a sports or multimedia watch, the rechargeable battery can be charged via the electrical connector, which can be connected by cable to a charger. The electrical connector is mounted in a housing in the last bracelet link, which has a wall abutting against the middle part of the case to hold it in a fixed position. A connection area of the electrical connector abuts or is secured to electrical connection terminals of the connection element, which may be a flexible Zebra connector.

BRIEF DESCRIPTION OF THE DRAWINGS

The objects, advantages and features of a wristwatch provided with an electrical connector will appear more clearly in the following non-limiting description with reference to the drawings, in which:

FIG. 1 shows a partial, three-dimensional bottom view of the wristwatch at the connection of the bracelet to the watch case according to the invention, FIG. 2 shows a partial, three-dimensional, exploded, bottom view of the wristwatch prior to the assembly of a bracelet strand with the electrical connector to the watch case according to the invention, FIG. 3 shows a partial, longitudinal cross-section at the connection of the bracelet to the watch case according to the invention, and FIG. 4 shows a partial side view of the middle part of the watch case with the electrical connection element through the watch case according to the invention.

DETAILED DESCRIPTION OF THE INVENTION

In the following description, all those components of the wristwatch that are well known to those skilled in the art in this technical field will be described only in a simplified manner. The emphasis is mainly placed on the arrangement of the electrical connector on the wristwatch.

FIGS. 1 to 3 show partial three-dimensional views or partial cross-sections of watch 1 with a bracelet 4, 4'. Watch 1 is provided with an electrical connector 5, arranged, in particular, in the bracelet. Said watch 1 may be an electromechanical watch powered by a supply voltage source or a battery (not shown). The supply voltage source or the battery is arranged in the case above the back cover 2 of the watch case. The battery may be a rechargeable battery. Back cover 2 is secured, for example by means of screws 22, to middle part 3 of the case with the insertion of a conventional sealing gasket. Middle part 3 and back cover 2 are closed by a crystal 8 and the bezel thereof. Crystal 8 is disposed above a watch dial (not shown) with hands indicating the time or a display screen, in particular an LCD screen.

The bracelet may be formed of two strands 4, 4', with an unfolding clasp or a conventional clasp. In the example shown in FIGS. 1 to 3, the bracelet is a metal bracelet formed of two strands 4, 4' provided with a series of links connected to each other by means of pins to allow them to pivot in relation to each other. The last link of each bracelet strand 4, 4' includes a through aperture 23 in order to be secured between the horns of middle part 3 of the case by a tube 7' and pin 7 assembly in circular apertures 13 in the horns. Each last bracelet link, which is secured to middle part 3 of the case, has a wall 14, an external face of which abuts against an outer surface 12 of middle part 3 of the case to hold it in a fixed position preventing rotation. Preferably, at least one whole portion of the external face of wall 14 abuts against one portion of the outer surface 12 of the middle part. The outer surface 12 may be flat or may define a portion of a cylinder. The external face of wall 14 has a complementary shape to outer surface 12 of middle part 3 so as to abut completely against this outer surface 12.

Watch 1 includes an electrical connector 5, which is preferably a female USB electrical connector. This USB electrical connector or USB plug is disposed inside bracelet 4, 4' at the end of the bracelet secured to middle part 3 of the case between two conventional securing horns. The female electrical connector 5 may be partly integrated in the material of the bracelet or preferably be disposed in a housing 6 in the bracelet. Housing 6 in bracelet 4 is open on the inner surface side which is not visible when watch 1 is worn on the user's wrist.

In the case of a metal bracelet formed of links as indicated above, the female USB electrical connector is disposed in a housing 6 in a last link secured to the middle part 3 of the case. Wall 14 defines a wall of housing 6, which is located between the securing apertures 23 and surface 12 of middle part 3. Housing 6 is of complementary shape to the external portion of electrical connector 5. This external portion of electrical connector 5 may be made of insulating material, if electrical connector 5 is inserted in a housing 6 in the metal link.

Once inserted inside housing 6 in the last link, the USB electrical connector 5 has an electrical connection area accessible through a passage 24 in wall 14 of the last link. This connection area of electrical connector 5 is intended to abut or be secured or welded to the electrical connection terminals of a connection element 15. As shown in FIG. 4, this connection element 15 is fixed in a sealed manner through an aperture 16 in surface 12 of middle part 3. This portion of middle part 3 with surface 12 may be made of insulating material or also of metallic material like the whole of middle part 3, but in that case the periphery of the connection element must be electrically insulated.

Connection element 15 is mechanically and electrically connected inside the case to a printed circuit board 25 carrying one or several electronic circuits (not shown) for the operation of the watch. Printed circuit board 25 is connected in a conventional manner to the battery for electrically powering the electronic circuits. Connection element 15 extends towards the exterior of the case entering passage 24 in wall 14 for mechanical and electrical connection to the connection area of electrical connector 5. This connection element 15 may be a flexible Zebra connector.

Preferably, electrical connector 5 is placed in housing 6 in the last link of bracelet 4 before the bracelet is secured to the middle part 3 of the case. The last bracelet link 4 is then fixed to middle part 3. Contact pressure can thus be applied between the connection area and the connection terminals of connection element 15 to establish the electrical connection. With this configuration, it is easy to change bracelet 4, 4' of watch 1 and also electrical connector 5 in housing 6 of the last link.

Preferably, the female USB electrical connector or plug is arranged to receive a complementary USB flash drive or a USB connector plug of an electrical charger or an electronic instrument, such as a computer station. The USB plug may be a micro-USB plug. It may thus be arranged to charge the rechargeable battery or also to transfer data from the watch to the computer station or from the computer station to the watch. A USB flash drive provided with a wireless data transmission device may also be connected to the USB electrical connector.

The connection of the USB flash drive or plug in USB electrical connector 5 of the bracelet can only occur once the watch is removed from the user's wrist. The female USB electrical connector 5 is arranged to receive the USB flash drive or USB plug in a vertical direction, namely in a direction perpendicular to the inner face of the bracelet or to back cover 2 of the case. This facilitates insertion of the USB flash drive or of the USB plug once the watch is placed on the watch crystal 8 side on a support, such as a table.

From the description that has just been given, several variants of the wristwatch provided with an electrical connector can be devised by those skilled in the art without departing from the scope of the invention defined by the claims. It is possible to envisage having two electrical connectors of different or identical types at the two ends of the bracelet secured to the watch case on the inner face which is not visible once the watch is worn by the user. The bracelet may be a plastic bracelet with the electrical connector integrated in the plastic material in a position between the two securing horns and on the side of the bracelet surface in contact with the user's wrist. The female or male electrical connector in the bracelet may also be an HDMI electrical connector or another type for transferring data between the watch and an electrical apparatus connected to the electrical connector. The aperture in the electrical connector could also be closed with a protective cover arranged in the extension of the inner bracelet surface. The protective cover may slide at the end of the bracelet to cover or reveal the electrical connector aperture. The connection element and electrical connector may form a single part.

What is claimed is:

1. A wristwatch, comprising:

a bracelet;

an electrical connector connected via a connection element to at least one electronic circuit and/or to a rechargeable battery which are disposed inside the watch case, wherein the electrical connector is disposed in a housing made in the bracelet on an inner surface of the bracelet, and arranged in an end portion of the bracelet where the bracelet is secured to the middle part of the watch case, wherein the bracelet is formed of two strands provided with a series of links connected to each other, a last link of each bracelet strand is fixed to the middle part of the case each on an opposite side of the middle part, and wherein the last link of one of the bracelet strands includes the housing, in which the electrical connector is arranged, and wherein at least the last link of the strand, which includes the housing, has a wall, an external face of which abuts against an outer surface of the middle part of the case to hold the link in a fixed position preventing rotation.

2. The wristwatch according to claim 1, wherein the electrical connector is a female electrical connector for receiving a male connector of an electrical charger or of an electronic instrument, and wherein the female electrical connector is disposed in the end portion of the bracelet with the aperture of the female electrical connector on the inner surface side of the bracelet.

3. The wristwatch according to claim 2, wherein the female electrical connector is a USB electrical connector.

4. The wristwatch according to claim 3, wherein the female USB electrical connector is disposed on the internal surface for receiving a male electrical connector in a vertical direction of insertion or perpendicular direction relative to an inner curve of the bracelet or to the internal surface of the bracelet.

5. The wristwatch according to claim 1, wherein the bracelet is a metal bracelet, wherein the last link of each strand includes a through aperture in order to be fixed between horns of each opposite side of the middle part of the case by a pin, or by a tube and pin assembly in circular apertures in the horns.

6. The wristwatch according to claim 1, wherein the outer surface of the middle part of the case is flat or defines a portion of a cylinder, and wherein an outer face of the wall has a complementary shape to the outer surface of the middle part so as to abut completely against said outer surface.

7. The wristwatch according to claim 1, wherein the connection element is fixed in a sealed manner through an aperture in the middle part of the case, wherein the connection element is mechanically and electrically connected inside the case to a printed circuit board carrying at least the electronic circuit.

8. The wristwatch according to claim 1, wherein the connection element is fixed in a sealed manner through an aperture in the surface of the middle part, wherein the connection element is mechanically and electrically connected inside the case to a printed circuit board carrying at least the electronic circuit, and wherein the connection element extends towards the outside of the case through a passage in the wall for mechanical and electrical connection to a connection area of the electrical connector disposed in the housing.

9. The wristwatch according to claim 8, wherein the connection element is a flexible connector.

* * * * *